US008210540B2

(12) United States Patent
Fishon et al.

(10) Patent No.: US 8,210,540 B2
(45) Date of Patent: Jul. 3, 2012

(54) CARD GAME WITH NEW WILD CARD RANDOMLY SELECTED EACH ROUND

(76) Inventors: Todd D Fishon, Lewisburg, WV (US); Michael Bromley, Lewisburg, WV (US)

( * ) Notice: Subject to any disclaimer, the term of this patent is extended or adjusted under 35 U.S.C. 154(b) by 0 days.

(21) Appl. No.: 12/818,074

(22) Filed: Jun. 17, 2010

(65) Prior Publication Data

US 2012/0046086 A1 Feb. 23, 2012

(51) Int. Cl.
*A63F 1/00* (2006.01)

(52) U.S. Cl. ..... 273/292; 273/274; 463/13

(58) Field of Classification Search ..... 463/13, 463/16, 20–30; 273/292, 174
See application file for complete search history.

(56) References Cited

U.S. PATENT DOCUMENTS

| | | | | |
|---|---|---|---|---|
| 6,386,973 | B1 * | 5/2002 | Yoseloff | 463/13 |
| 2003/0064798 | A1 * | 4/2003 | Grauzer et al. | 463/29 |
| 2005/0082750 | A1 * | 4/2005 | Grauzer et al. | 273/149 R |
| 2007/0170652 | A1 * | 7/2007 | Perrie et al. | 273/292 |
| 2008/0007003 | A1 * | 1/2008 | Davis et al. | 273/292 |

* cited by examiner

*Primary Examiner* — Masud Ahmed

(57) ABSTRACT

A casino wagering game dealt with a predetermined amount of cards where each round features one of the thirteen ranks randomly selected to be wild after the initial ante, dealing the hands and wagering on the hands as dealt prior to randomly selecting the new wild card for the round. Any player or dealer having a hand that contains the rank that is selected to be wild may use that card to improve their hand. A random number generator or random selection from a full deck of cards may be used to determine the new wild card for each round.

16 Claims, 6 Drawing Sheets

21

2 PAIR PLUS

Five of a Kind.....100 to 1
Straight Flush..... 40 to 1
Four of a Kind
(Aces, Kings, Queens)..... 30 to 1
(Two - Jack)..... 12 to 1
Full House ..... 10 to 1
Flush ..... 6 to 1
Straight ..... 4 to 1
Three of a Kind ..... 2 to 1
Two Pair ..... 1 to 1

FIG. 2

| | |
|---|---|
| Five of a Kind | A_, A_, A_, A♣, wild card |
| Royal Flush | A_, K_, Q_, J_, 10_ |
| Straight Flush | Q_, J_, 10_, 9_, 8_ |
| Four of a Kind | 7_, 7_, 7_, 7♣, and any card that is not the wild rank |
| Full House | 7_, 7_, 7_, A_, A♣ |
| Flush | A♣, J♣, 7♣, 5♣, 2♣ |
| Straight | Q_, J_, 10_, 9_, 8_ |
| Three of a Kind | A_, A_, A_, any two singletons that are not the wild rank |
| Two Pair | A_, A_, 7_, 7_, any card (no Ace, 7, or wild rank) |
| One Pair | 8_, 8_, three singletons that are not the wild rank |
| High Card | K_, J_, 9_, 7_, 2_ |

FIG. 4

| Player's Hand | Dealer's Hand | Player's Call Bet | Wild Card | Ante Resolution | Call Resolution |
|---|---|---|---|---|---|
| A_,A_,7_,7_,J_, | 6_,6_,7♣,5♣,2♣ | yes | 4 | Pays 1 | Pays 1 |
| 10_,10_,9_,7_,J_ | A_ Q_,J_,9_,2_ | yes | 6 | Pays 1 | Push |
| 8_,8_,9_,7_,J_ | A_ K_,Q_,J_,3_ | yes | 3 | Lose | Lose |
| A_ K_,9_,9_,3_ | A_ Q_,J_,5_,2_ | yes | 9 | Pays 1 | Pays 1 |

FIG. 5

CARD GAME WITH NEW WILD CARD RANDOMLY SELECTED EACH ROUND

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to card games and particularly to a casino poker card game using a new wild card for each round of play randomly selected after an opening bet, dealing hands to each player, and placing a bet on the dealt hand prior to randomly selecting the new wild card.

2. Description of Related Art Including Information Disclosed Under 37 CFR 1.97 and 1.98

In the past, gaming establishments have offered a variety of poker games to players having different levels of sophistication. The variety of poker games both maintains and increases interest in poker play and provides diversified profit centers for gaming establishments. Such poker games include both table games and machine-generated games. Some players have a greater preference for playing a poker table game where players feel they are using a level of player skill to determine the outcome of the poker table game, as opposed to playing a machine-generated poker game requiring less player skill.

There are poker games that use wild cards which are predetermined such as "Deuces Wild" where all cards with a rank of 2 are wild. Other examples would be poker games that contain a joker where the joker can be used to substitute for any rank or suit. There are poker games that have wild cards that have specific abilities such as the joker in Pai Gow Poker. The joker can only be used as an ace or to complete any straight or flush.

With a predetermined wild card, the value of a player's hand is immediately determined upon inspection. In order to create an environment where a player's hand can change during the course of play, some poker games allow the wild card to be determined while the game is in progress. For example, during a round of poker, a card that follows a predetermined card will be the wild card. If the predetermined card is a rank of 3, the card that is dealt directly after the 3 is now the wild card for the hand and will remain wild until the round is over or another 3 is dealt. In this case the next card dealt is now the wild rank and the previous wild card reverts back to its regular status.

Prior art poker games suffer from numerous disadvantages. One such disadvantage is simply that many players are tired or bored with prior art poker games, many of which have been available for decades. Games, such as the variations of Texas Hold 'Em, have experienced success in casinos by giving the players a chance to improve their hand up until the last card is dealt. With the inclusion of a randomly selected wild card that changes for each round of play, the players will have more opportunities to better their hand as the game progresses and create the feeling that there are more chances to win.

U.S. Pat. No. 5,947,821, issued Sep. 7, 1999 to Stone, is for an apparatus and method for playing a card game, which provides a player with an initial choice of selecting at least one card from a plurality of cards to be designated as a wild card. The player then receives a random first hand from a full deck of cards. The first hand of cards are compared with the designated wild card to determine all matching cards and designating all matching cards in the first hand as wild cards. The player may then be provided with the option of replacing cards in the first hand with cards remaining in the deck. All replacement cards which match the wild card will also become wild. The player is also provided with an option of buying a second wild card after a losing card hand. This provides the player with an opportunity to change a losing card hand into a winning card hand. After a winning card hand the player is provided with a double or nothing option which provides a further dynamic game exchange between player and game.

U.S. Pat. No. 5,308,065, issued May 3, 1994 to Bridgeman et al, provides a game of chance and skill where a player, after making a wager, is dealt, face-up, a hand of five cards which is placed in a player-hand area. The player also receives a solitary card, which is dealt face down in a single-card area. The player then has a chance to improve the ranking of the five-card hand by discarding up to five cards and replacing them with an equal number of new cards. After the player rearranges the five-card hand, the solitary card is turned face-up and all the cards in the player's hand which have the same face value as the solitary card are designated wild. The ranking winnings are calculated according to a statistical pay table.

What is needed is a game of chance in which a new wild card is randomly selected for each round after an opening bet, dealing the hands, and betting on the hands prior to the wild card selection to create an environment where a player's hand can change during the course of play to encourage continued play and betting based on a possibility of improving the hand after betting and then determining the net wild card for the round.

BRIEF SUMMARY OF THE INVENTION

A primary object of the present invention is to provide a casino card game of chance in which a new wild card is randomly selected for each round after an opening bet, dealing the hands, and betting on the hands prior to the wild card selection to create an environment where a player's hand can change during the course of play to encourage continued play and betting based on a possibility of improving the hand after betting on a hand prior to wild card determination and then determining the net wild card for the round which might improve a player's hand containing at least one card ranked as the randomly selected wild card for the round.

One embodiment of the invention is a method of playing a five card poker game. In one embodiment, the game is played with a set of playing cards comprising at least one deck of playing cards and a random number generator which will determine which of the thirteen ranks will be wild for the current round of play.

Each player of the game places an ante or first wager in order to be entitled to play the game. Each player may place an optional third wager that their hand will achieve at least a first predetermined rank. Each player is dealt a five card hand from the set of playing cards. A five card hand is also dealt to the dealer or house. Each player is then permitted to evaluate their cards for the best five card hand and either (1) fold (and lose their ante); or (2) place a second or "Call" wager. The second wager can be an even amount to the ante bet.

After all "Call" wagers are made, one of the thirteen ranks is randomly selected to be the wild card for the current round of play. In one embodiment, a random number generator will select the wild rank. Any player or dealer that has a card or cards of the same rank as the selected wild card can use that card or cards to be any rank or suit needed to better their hand. If a player's hand consists of an ace of spade, 10 of diamond, 7 of diamond, 5 of club, and 2 of heart, and the wild card selected is a 5, the player can make their 5 of club wild and use it as an ace to make a pair of aces. If a player's hand consists of an ace of diamond, 10 of diamond, 7 of diamond, 5 of club, and 2 of diamond, and the wild card selected is a 5, the player can make their 5 of club wild and use it as a king of diamonds and form a flush.

If a player places the second wager, the outcome of the game is then determined by comparison of the player's hand to the dealer's hand and/or by comparison of the player's hand to a pay table. In one embodiment, the player is paid winnings on their third wager if their hand met the first predetermined rank.

The game also includes the step of determining if the dealer's hand "qualified," such as by having a predetermined minimum rank. In one embodiment, the dealer needs a minimum poker rank of ace/king high to qualify. If not, then the player is paid winnings based upon their Ante Bet and their second wager is returned. If so and the player's hand outranks the dealer's hand, the player is paid winnings based upon their ante bet and their second or "Call" wager.

In accordance with another embodiment of this invention the gaming table layout for presenting the game of the invention are disclosed.

BRIEF DESCRIPTION OF THE SEVERAL VIEWS OF THE DRAWINGS

These and other details of the present invention will be described in connection with the accompanying drawings, which are furnished only by way of illustration and not in limitation of the invention, and in which drawings:

FIG. 2 illustrates an exemplary pay table for Two Pair Plus wager of a game of the invention;

FIG. 4 is an exemplary diagram showing hand rankings of playing cards;

FIG. 5 is an exemplary diagram showing a comparison of exemplary dealer hands to exemplary player hands and resulting game outcomes;

DETAILED DESCRIPTION OF THE INVENTION

Figure 1:
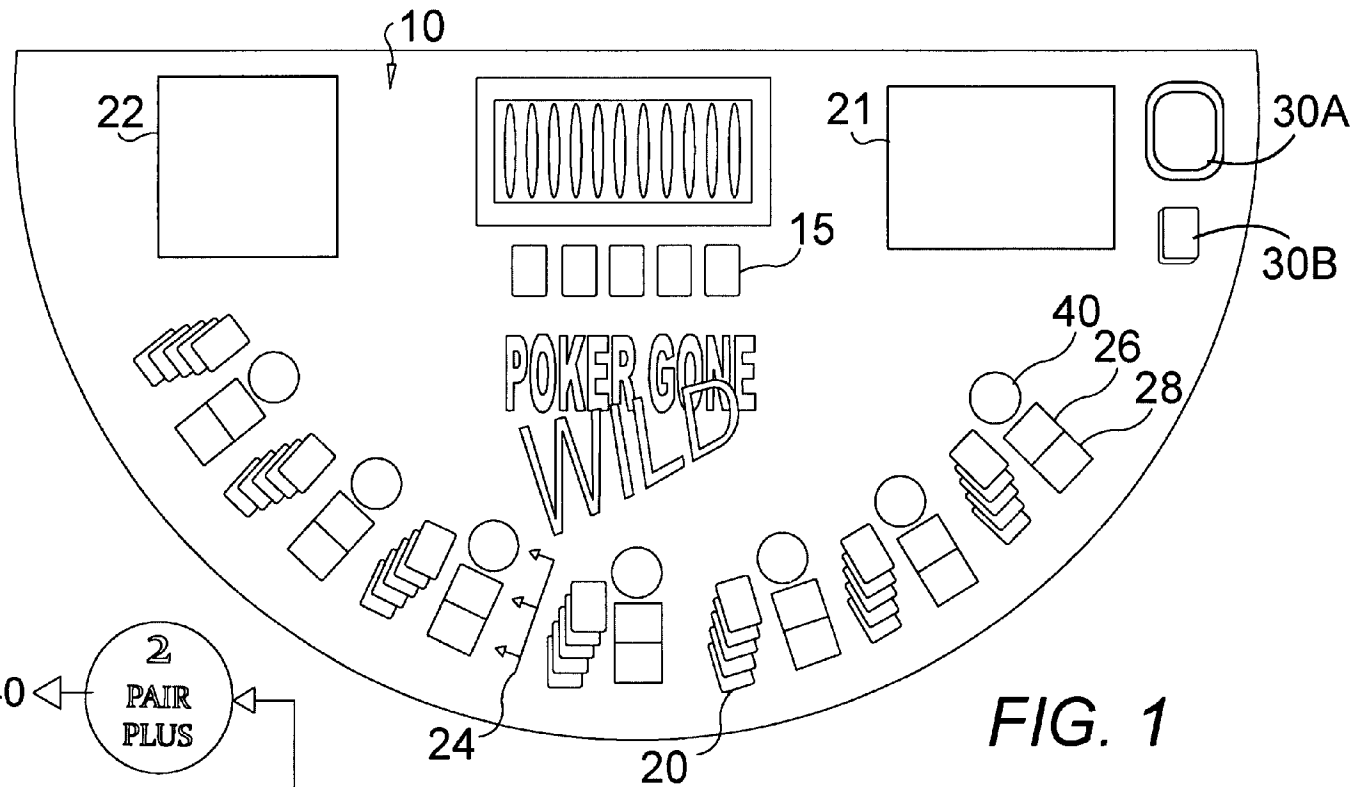
FIG. 1 is a top view of a gaming table layout for a gaming table for use in playing a game of the invention according to an embodiment of the present invention.

In FIGS. 1-5, a method of playing a casino wagering card game played on a prescribed gaming table layout 10 for the game, wherein the method comprises the following steps:

(A) providing at least one standard deck of playing cards;

(B) each player making an initial wager for a round that the player's own hand will have a higher poker value than the dealer's hand, placing the initial wager in a labeled "Ante" betting section, one of an array of wagering sections in a wagering region 24;

(C) a dealer dealing five cards to each player making an initial wager to form each player's hand 20 and dealing five cards to the dealer to form the dealer's hand 15;

(D) each player choosing between making a second wager in a labeled "Call" betting section, one of an array of wagering sections in a wagering region 24 to remain in the game, or folding to leave the round forfeiting their initial wager;

(E) selecting a rank by a random method to be a wild card so that each player having at least one wild card rank in their hand can use that at least one wild card rank as any desired card of any rank or suit to enhance their hand;

(E) evaluating the dealer's hand so that if the dealer's hand exceeds a predetermined rank, the dealer's hand qualifies to play, and subsequently evaluating how the dealer's hand compares to each of the player's hands and paying or taking the wagers accordingly, and if the dealer's hand does not exceed a predetermined rank, the dealer paying the initial wagers of all players that made a second wager.

The step of selecting a rank by a random method comprises selecting one of thirteen ranks of a standard fifty-two card deck randomly selected to be wild in each round, preferably a separate complete 52 card deck. Alternately, a random number generator may determine the rank of the new wild card in each round.

The step of evaluating the dealer's hand may require that the dealer's hand has the predetermined rank of Ace King high or better to qualify the dealer to play.

The step of evaluating a player's hand may provide that if the player's hand has a poker value that exceeds a predetermined rank that would enable the player to automatically win their initial and second wagers, which may preferably be a rank of three aces or better enabling the player's hand to automatically win.

The game may be further enhanced by the step of the player alternately putting a multiple of their initial wager to remain in the game.

Another further enhancement may include the step of the players making a third wager that wins based on the poker value of each of their five card hands compared to a predetermined pay table, wherein the pay table may include all hands with a poker value of two pair or higher.

The pay table payout may be 1 to 1 for two pair, 2 to 1 for three of a kind, 4 to 1 for a straight, 6 to 1 for a flush, 10 to 1 for a full house, 12 to 1 for a four of a kind consisting of 2's thru jacks, 30 to 1 for a four of a kind consisting of queens thru aces, 40 to 1 for a straight flush, and 100 to 1 for five of a kind The third wager may be called Two Pair Plus.

The method of playing a casino wagering card game of the present invention may be carried out on a gaming table having chairs for the dealer and players, using the table layout configuration of FIG. 1, which may be in a gambling casino having a dealer working for the gambling casino at each table.

Figure 6:
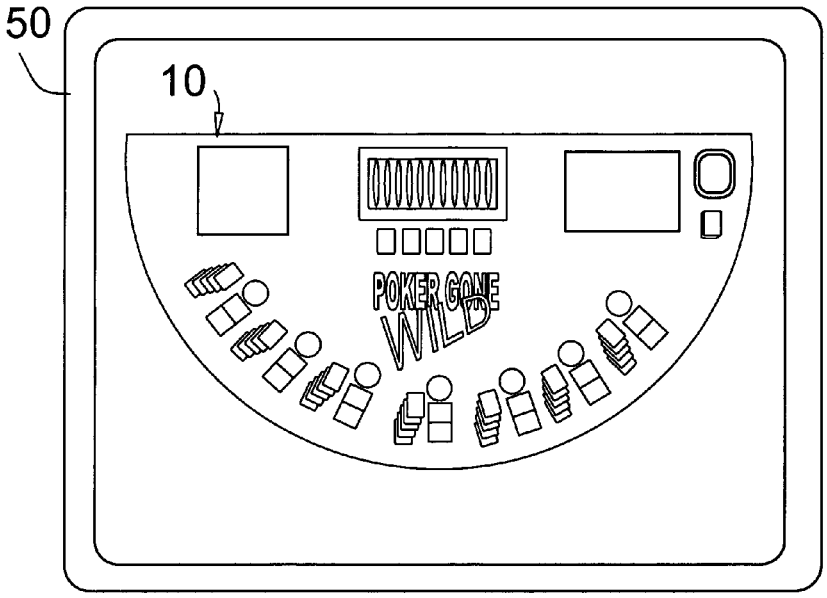
FIG. 6 is a front elevational view of a video terminal employing a video representation of the method of playing a casino wagering card game of the present invention.

The method of playing a casino wagering card game of the present invention may be carried out by creating a video representation of the casino wagering card game and playing the game using a video terminal 50, as shown in FIG. 6.

Figure 7:
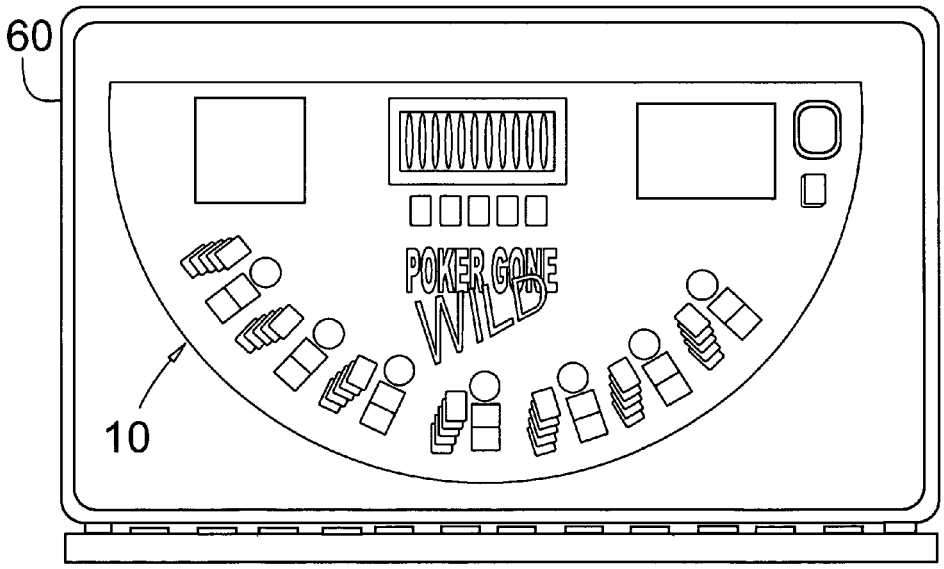
FIG. 7 is a front elevational view of a laptop computer employing an electronic digital representation of the method of playing a casino wagering card game of the present invention using an electronic digital device, which may be a remotely connected electronic digital device, and may be communicating on the Internet.

The method of playing a casino wagering card game of the present invention may be carried out by creating an electronic digital representation of the casino wagering card game and playing the game using an electronic digital device, which may be a remotely connected electronic digital device, and may be an electronic digital device communicating on the Internet, such as on a laptop computer 60, as shown in FIG. 7.

In use, FIG. 1 illustrates an example embodiment of a gaming table layout 10 for use in playing a poker wagering game of the invention. The poker wagering game of the invention is hereinafter denoted as the "game."

In accordance with this example, in FIG. 1, the gaming table layout 10 comprises a dealer location 15 (on one side of the gaming table layout), at least one player location 20 (on an opposite side of the gaming table layout) and at least one wagering region 24. A dealer (sometimes referred to as the "bank" or as the "house") is located in the general area of the dealer location 15. As few as one, and preferably two or more player positions are located in the general area of the player locations 20. Generally, and without any limitation, as few as one and as many as two or more players may play the game. It is contemplated that a player may occupy any player location 20 that is not occupied by another player. If permitted, a single player may also be permitted to occupy more than one player location 20, such as being permitted to place wagers at more than one location.

Figure 3:
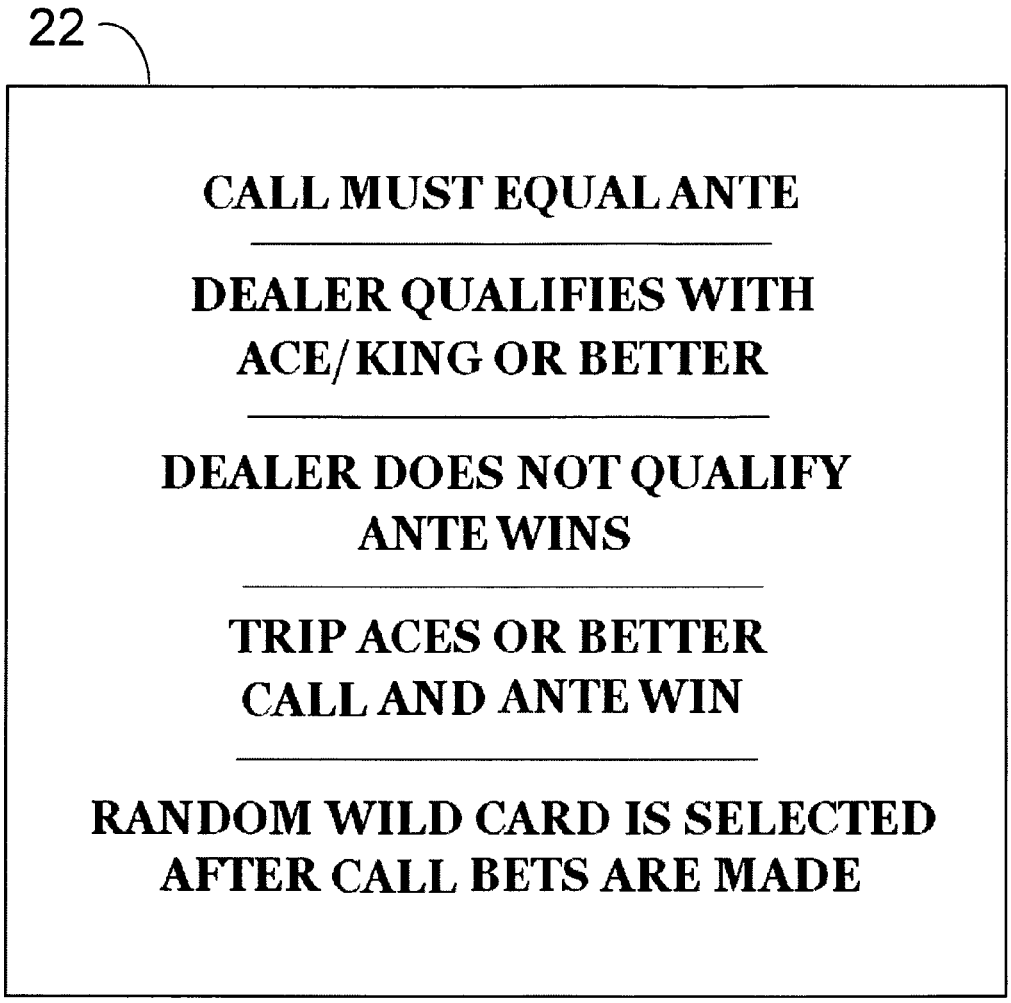
FIG. 3 illustrates a rules table portion of the gaming table layout.

Referring again to FIG. 1, the gaming table layout 10 may further comprise player display regions 21 and 22 configured to display other information. In one embodiment, the display region may display any one or more of the following: at least one pay table 21 (FIG. 2) and at least one rules table 22 (FIG. 3). The payouts of the pay tables (FIG. 2) including the particular game outcomes or hands which are entitled to payment of winnings, may be varied by an operator, such as a casino or house, of the game.

Figure 1A:
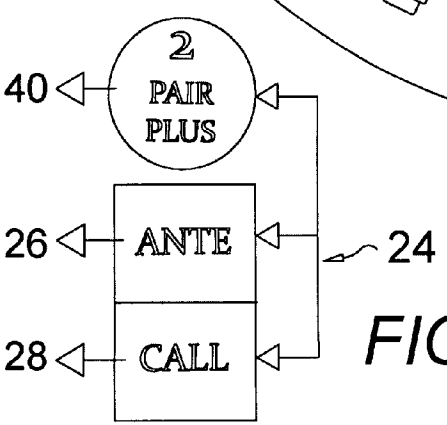
FIG. 1A illustrates a wagering portion of the gaming table layout illustrated in FIG. 1.

Referring to FIG. 1A, in one example embodiment, the wagering region 24 includes at least an Ante portion 26 provided for a first wager or Ante, a Two Pair Plus portion 40 provided for an optional third wager, and a Call portion 28 for a second wager. As illustrated, an ANTE identifier is located on the Ante portion 26, a Two Pair Plus identifier is located on the Two Pair Plus portion 40 and a Call identifier is located on the Call portion 28. These identifiers denote the type of wager to be placed on the appropriate portion of the wagering region of the gaming table layout 10.

It should be understood that the identifier of each of the Ante portion 26, Call portion 28 and Bonus portion 40 may be any suitable identifier to distinguish between sequenced wagers of the game. For example, an alternative identifier for the Bonus portion 40 may be a Two Pair Plus identifier or a JACKPOT identifier or the like.

In one example embodiment the game is played with one or more decks of playing cards. In one embodiment, the one or more decks of playing cards comprises fifty-two playing cards having a plurality of suits and each playing card of each suit of the plurality of suits having predetermined ranks. The suits may comprise four suits such as Spades, Hearts, Diamonds and Clubs or any other suitable number of suits. The ranks of the deck of playing cards include nine playing cards numbered from 2 to 10 and four playing cards denoted Ace, Jack, Queen and King, with the rank of each playing card of each suit ascending from the lowest numbered playing card denoted 2 to the highest playing card denoted Ace.

As used herein, the term "wild playing card" means a playing card that may take or assume different characteristics, such as different ranks or values. In one preferred embodiment where the wild playing card can be used to complete any flush or straight, or to match a player's highest card to form a pair, highest pair to form a three of a kind or a full house, three of a kind to form a four of a kind, or four of a kind to form a five of a kind.

For example, the player may receive the following set of playing cards: a 5 of Clubs, a 4 of Hearts, a 3 of clubs, a 2 of clubs, and 10 of diamonds. If the random wild card selected is a 10, the player can use their ten to substitute for the rank of a 6 and make a 2, 3, 4, 5, 6 straight. Alternatively, the player may receive the following set of playing cards: a 5 of Clubs, a 5 of Hearts, a 5 of Diamonds, an 8 of clubs, and a 10 of clubs. If the random wild card selected is a 5, the player can substitute their three fives for a nine of clubs, Jack of clubs, and a Queen of clubs and form a straight flush.

Without limitation, other indicia may be used in place of the ranking described, so long as the indicia permit players to understand/identify the rank of each playing card. Additionally, the operator of the game may desire to use more than one deck of playing cards and more than one wild playing cards.

In order to simplify the remaining description, the term Ace may be abbreviated to A, the term King may be abbreviated to K, the term Queen may be abbreviated to Q and the term Jack may be abbreviated to J.

Hand Rankings

FIG. 4 is an exemplary diagram showing rankings of hands of playing cards in accordance with an embodiment of the invention. Using the wild card, five of a kind is deemed the highest rank. As shown in FIG. 4, a Straight Flush of the game comprises the five card hand with five consecutive cards of rank and of the same suit. By way of example, and not limitation, and referring to the third row of FIG. 4 next to the term "Straight Flush", the five card hand comprises the Q of Diamonds, J of Diamonds, 10 of Diamonds, 9 of Diamonds, and the 8 of Diamonds. The terms "Four of a Kind", "Full House", "Flush", "Straight", "Three of a Kind", "Two Pair", "Pair", and "High Card" are generally understood by one of ordinary skill in the art and hence are not described in detail. In general, a flush comprises five cards of any value or value which are of the same suit. A straight comprises five cards of any suit in sequential rank. A pair comprises two cards, of any suit, with the same rank or value. A high card hand comprises a hand which does not make up any of the hands above, and which is ranked simply by the value of highest card in the hand.

Method of Table Game Play

One method of playing a game using the table layout illustrated in FIG. 1 will now be described in detail. The game is played with at least one deck of playing cards.

Each player who wishes to play the game places a first bet or wager ("Ante"). Each Ante is preferably received in the corresponding Ante portion 26 of the layout 10. Each player who places an Ante may also place an optional third bet or wager ("Two Pair Plus wager"). Each Two Pair Plus wager is preferably received in the corresponding Two Pair Plus portion 40 of the layout 10. The Two Pair Plus wager is a wager that the player's hand 44 will achieve at least a first predetermined rank.

In one embodiment, after each player who desires to play the game has placed an Ante and any optional Two Pair Plus wager, the dealer deals a five card hand from the deck of playing cards to each player. The dealer also deals a dealer five card hand. Each player may then inspect their player hand.

In one embodiment, various outcomes of the game are dependent upon whether the dealer's hand qualifies. In one embodiment, for the dealer's hand to qualify, it must meet or exceed a predetermined rank. In one embodiment, the dealer's hand qualifies if it has a ranking of an ace/king high or better.

After the player hands have been dealt, and preferably after each player has had an opportunity to inspect their hand, each player has the opportunity to place a second bet or wager ("Call wager"). Each Call wager is preferably received in the corresponding Call portion 28 of the layout 10. If a player does not place a Call wager, the player "folds" and is out of the game and forfeits their Ante wager.

After all players have an opportunity to place a Call wager, the dealer collects any wagers by, and player hands belonging to, players who did not place a Call wager. Each player who did place a Call wager remains in the game (referred to herein as an "active player"), and the wild card will be randomly selected. The outcome of the game is then determined by evaluating each player hand relative to the dealer hand and/or one or more pay tables.

In one embodiment, the dealer first determines if the dealer's hand qualifies. As described above, this may comprise determining if the dealer hand has a ranking of at least an ace/king high. If the dealer's hand does not qualify, then the dealer pays each active player an amount based on the player's Ante according to the predetermined pay table. A player that has a hand with a ranking of a three Aces or better will be automatically paid on both their Ante and Raise wagers. In one exemplary payout scheme, the amount paid to each active player is at least 1 to 1 of the Ante. If the dealer's hand does qualify, then the dealer compares the dealer hand to the player hand of each active player. The dealer settles with each player in turn as follows: if the player's hand ranks higher than the dealer's hand, then the dealer pays to the player an amount based on both their Ante and their Call wager; and if the player's hand ranks lower than the dealer's hand, then the player forfeits both their Ante and their Call wager to the dealer. Hands that have the same poker value are a push.

If the player's hand ranks higher than the dealer's hand, then in one exemplary payout scheme the amount paid to the player is at least 1 to 1 of their Ante. If the player's hand ranks higher than the dealer's hand, then in one exemplary payout scheme, the amount paid to the player for their Call wager is at least 1 to 1 of their Ante.

In one embodiment of the invention, each active player who placed a Two Pair Plus wager is paid winnings if their hand meets a predetermined minimum rank. In one embodiment, the player's are paid winnings for their Two Pair Plus wager in accordance with a pay table. One exemplary Two Pair Plus wager pay table is as follows:

| | |
|---|---|
| Five of a Kind | At least 100 to 1 (of the Two Pair Plus wager) |
| Straight Flush | At least 40 to 1 |
| Four of a Kind (Aces thru Queens) | At least 30 to 1 |
| Four of a Kind (2's thru Jacks) | At least 12 to 1 |
| Full House | At least 10 to 1 |
| Flush | At least 6 to 1 |
| Straight | At least 4 to 1 |
| Three of a kind | At least 2 to 1 |
| Two Pair | At least 1 to 1 |

If the player's hand is other than a winning hand (for example, pair of 4's), the player loses their Two Pair Plus wager (the dealer collects the wager).

As described in more detail below, in one embodiment, each active player is paid for any winning hand when the player placed a Two Pair Plus, regardless of the outcome of the dealer's hand (i.e. regardless of whether the dealer's hand qualified and regardless of whether the player's hand beat the dealer's hand). In such an embodiment, the player's Two Pair Plus wager is simply a wager that their hand will achieve a particular minimum ranking which entitles them to a payout.

The operator of the game may define a minimum and/or maximum wager amount for the Ante, Call, and Two Pair Plus wagers. These minimums and maximums may be different for the different wagers. For example, a minimum Ante of $1 may be required, while a maximum Two Pair Plus wager of $25 may be permitted.

Exemplary Game Outcome Determinations

FIG. 5 illustrates various player and dealer hands and game outcomes in accordance with the above-described method. In this figure, the first column, entitled "Player's Hand," illustrates an exemplary player hand for a particular game. The second column, entitled "Dealer's Hand," illustrates an exemplary dealer hand for each corresponding game. The third column, entitled "Player's Call Wager," indicates whether the player placed a Call wager. The fourth column indicates the randomly selected wild card. The fifth column indicates the payout to the player for their Ante (in all cases, it is assumed the player placed an Ante, or else the player would not have received their player hand), if any, based upon the player and dealer hands illustrated in the corresponding first and second columns The sixth column indicates the payout to the player for their Call wager, if any, based upon the player and dealer hands illustrated in the first and second columns.

In a first example illustrated in the first row of the diagram of FIG. 5, the player has received "two pairs". The dealer's hand comprises playing cards with a poker rank of a pair of 6's . . . . The dealer's hand qualifies since it has a minimum rank of an ace/king high. However, the player's "two pair" outranks the dealer's "pair" (according to the rankings illustrated in FIG. 4. The dealer pays the player 1 to 1 for their Ante, and 1 to 1 for their Call wager.

In a second example illustrated in the second row of the diagram of FIG. 5, the player has received a "pair" of 10's. The dealer's hand comprises playing cards with the ranks of A, Q, J, 9, and 2 without 5 of the cards being of the same suit and no card matching the randomly selected wild card resulting in a hand of an Ace high. The dealer's hand does not qualify since it does not result in at least an ace/king high. Since the dealer hand did not qualify, the dealer pays the player 1 to 1 for their Ante and returns the player's Call wager.

In a third example illustrated in the third row of the diagram of FIG. 5, the player has received playing cards with the rank of a pair of 8's. The dealer's hand comprises playing cards with the ranks of A, K, Q, J, and 3 without 5 of the cards being of the same suit. The wild card is a 3 which makes the dealer's 3 wild and results in a hand of a straight. The dealer's hand outranks the player's hand since the dealer's straight, outranks the player's pair. Since the dealer hand qualifies (greater poker rank than an ace/king high.), the player loses both their Ante and Raise wagers.

In a fourth example illustrated in the fourth row of the diagram of FIG. 5, the player has received playing cards with the ranks of A, K, 9, 9, and 3 without 5 of the cards being of the same suit and the wild card is a 9. The player's cards with a rank of 9 are now wild resulting in a hand of three aces. The dealer's hand comprises playing cards with the ranks of A, Q, J, 5, and 2 without 5 of the cards being of the same suit resulting in a hand of an Ace high. Since the player's hand has a rank of three aces or better, the player automatically wins 1:1 for their Ante and Call Wagers despite the dealer not qualifying.

It is understood that the preceding description is given merely by way of illustration and not in limitation of the invention and that various modifications may be made thereto without departing from the spirit of the invention as claimed.

What is claimed is:

1. A method of playing a casino wagering card game, the method comprising the following steps:

(A) providing at least one standard deck of playing cards;

(B) each player making an initial wager for a round that the each player's own hand will have a higher poker value than a dealer's hand;

(C) the dealer dealing five cards to the each player making an initial wager to form said each player's hand and dealing five cards to the dealer to form the dealer's hand;

(D) each player choosing between making a second wager to remain in the game or folding to leave the round forfeiting their initial wager; and Upon making the second wager by a number of player among said each player;

(E) selecting a rank by a random method to be a wild card so that each player possibly can have at least one wild card rank in their hand, and said each player can use that at least one wild card rank as any desired card of any rank or suit to enhance their hand;

Wherein the selecting a rank by a random method comprises selecting one of thirteen ranks of a standard fifty-two card deck randomly selected to be wild in each round;

(F) evaluating the dealer's hand so that if the dealer's hand exceeds a predetermined rank, the dealer's hand qualifies to compete against said each player's hand to determine the winner and if the deal's hand does not exceed the predetermined rank, then the said each player win initial wager's hand and the second wager is returned to the number of player that made second wager.

2. The method of claim 1 comprising the step of using a random number generator to determine the rank of the wild card.

3. The method of claim 1 comprising the step of evaluating the dealer's hand having the predetermined rank of Ace King high or better qualifying the dealer to play.

4. The method of claim 1 comprising the step of evaluating a player's hand having a poker value that exceeds a predetermined rank enabling the player to automatically win their initial and second wagers.

5. The method of claim 4 comprising the step of evaluating a player's hand having the predetermined rank of three aces or better enabling the player's hand to automatically win.

6. The method of claim 1 comprising the step of the player alternately putting a multiple of their initial wager to remain in the game.

7. The method of claim 1 comprising the step of the players making a third wager that wins based on the poker value of each of their five card hands compared to a predetermined pay table.

8. The method of claim 7 comprising the step of the pay table including all hands with a poker value of two pair or higher.

9. The method of claim 8 comprising the step of the pay table being 1 to 1 for two pair, 2 to 1 for three of a kind, 4 to 1 for a straight, 6 to 1 for a flush, 10 to 1 for a full house, 12 to 1 for a four of a kind consisting of 2's thru jacks, 30 to 1 for a four of a kind consisting of queens thru aces, 40 to 1 for a straight flush, and 100 to 1 for five of a kind.

10. The method of claim 8 comprising the step of the third wager being called Two Pair Plus.

11. The method of claim 1 comprising the step of providing a gaming table and chairs for the dealer and players.

12. The method of claim 11 comprising the step of providing a gambling casino and a dealer working for the gambling casino at each table.

13. The method of claim 1 comprising the step of creating a video representation of the casino wagering card game and playing the game using a video terminal.

14. The method of claim 1 comprising the step of creating an electronic digital representation of the table game and playing the game using an electronic digital device.

15. The method of claim 1 comprising the step of creating an electronic digital representation of the table game and playing the game using a remotely connected electronic digital device.

16. The method of claim 1 comprising the step of creating an electronic digital representation of the table game and playing the game using an electronic digital device communicating on the Internet.

* * * * *